US010484800B2

(12) United States Patent
De Haan et al.

(10) Patent No.: US 10,484,800 B2
(45) Date of Patent: Nov. 19, 2019

(54) CONFIGURABLE HEARING AID COMPRISING A BEAMFORMER FILTERING UNIT AND A GAIN UNIT

(71) Applicant: Oticon A/S, Smørum (DK)

(72) Inventors: Jan Mark De Haan, Smørum (DK); Fares El-Azm, Smørum (DK)

(73) Assignee: Oticon A/S, Smørum (DK)

( * ) Notice: Subject to any disclaimer, the term of this patent is extended or adjusted under 35 U.S.C. 154(b) by 233 days.

(21) Appl. No.: 15/601,521

(22) Filed: May 22, 2017

(65) Prior Publication Data

US 2017/0339495 A1 Nov. 23, 2017

(30) Foreign Application Priority Data

May 23, 2016 (EP) ..... 16170771

(51) Int. Cl.
*H04R 25/00* (2006.01)

(52) U.S. Cl.
CPC ..... *H04R 25/407* (2013.01); *H04R 25/405* (2013.01); *H04R 25/453* (2013.01); *H04R 25/505* (2013.01); *H04R 25/558* (2013.01)

(58) Field of Classification Search
USPC ..... 381/313
See application file for complete search history.

(56) References Cited

U.S. PATENT DOCUMENTS 9,392,381 B1 * 7/2016 Park ..... H04R 25/554
10,051,384 B2 * 8/2018 De Haan ..... H04R 25/505
(Continued)

FOREIGN PATENT DOCUMENTS

EP 1469702 A2 10/2004
EP 2439958 A1 4/2012

OTHER PUBLICATIONS

Kuo et al. "Multiple-Microphone Acoustic Echo Cancellation System with the Partial Adaptive Process", 8424 Digital Signal Processing, vol. 3, Jan. 1993, No. 1, Orlando, FL, US, p. 54-63.

*Primary Examiner* — Quoc D Tran
(74) *Attorney, Agent, or Firm* — Birch, Stewart, Kolasch & Birch, LLP

(57) ABSTRACT

The application relates to a hearing aid comprising a forward path comprising a) a multitude of input units for providing a multitude of electric input signals $IN_i$, i=1, . . . , M, representative of sound, b) a multi input beam former filtering unit for providing a beam formed signal $Y_{BF}$ from said multitude of electric input signals, c) a gain unit for applying a hearing aid gain $G_{HA}$ to said beam formed signal $Y_{BF}$, and providing a processed signal, and d) an output unit for providing stimuli perceivable by a user as sound based on said processed signal or a signal derived therefrom. The hearing aid further comprises e) a gain control unit for limiting said hearing aid gain $G_{HA}$ to a modified full-on gain value $G'_{FOG}$. The multi input beam former filtering unit is configured to apply a current frequency dependent directional gain $G_{DIR,i}$ to each of said multitude of electric input signals $IN_i$, and the gain control unit is configured to determine the modified full-on gain value $G'_{FOG}$ in dependence of said current directional gains $G_{DIR,i}$, i=1, . . . , M, and a previously determined full-on gain value $G_{FOG}$. Thereby an improved hearing aid is provided. The invention may e.g. be used for hearing instruments, headsets, or active ear protection systems.

18 Claims, 4 Drawing Sheets

(56) References Cited

U.S. PATENT DOCUMENTS

| | | | | |
|---|---|---|---|---|
| 2005/0069162 | A1* | 3/2005 | Haykin | H04R 25/407 381/312 |
| 2008/0159559 | A1* | 7/2008 | Akagi | G10L 21/0208 381/92 |
| 2011/0116666 | A1* | 5/2011 | Dittberner | H04R 25/50 381/313 |
| 2013/0287237 | A1* | 10/2013 | Aubreville | H04R 25/40 381/313 |
| 2014/0364681 | A1* | 12/2014 | Hillbratt | H04R 25/30 600/25 |

* cited by examiner

CONFIGURABLE HEARING AID COMPRISING A BEAMFORMER FILTERING UNIT AND A GAIN UNIT

SUMMARY

The present disclosure relates to hearing devices, e.g. hearing aids, in particular to a hearing device comprising a beam former filtering unit for providing a beam-formed signal from a multitude of electric input signals representing sound from the environment of the hearing aid, and a processing unit allowing the execution of a number of configurable processing algorithms to modify an input signal representing said sound, e.g. according to the needs of a user of the hearing device.

The parameter Full-On Gain (FOG) limitation is an important feature for controlling the stability of digital hearing aids, by limiting the maximum allowable gain in the hearing aid. The full-on gain limitation is a characteristic of the hardware of the hearing aid and represents the maximum gain that can be applied to the hearing aid without causing mechanical feedback. The determination of the full-on gain (termed $G_{FOG}$ in the present disclosure) is typically performed according to a predefined, e.g. standardized, procedure (e.g. ANSI S3.22-2003: Specification of Hearing Aid Characteristics), e.g. with the gain control of the hearing aid set to its full-on position and with an input SPL of 50 dB. Alternatively, the measurement conditions may be indicated in a data sheet of the hearing aid together with the limiting Full-On Gain (FOG) value.

In state of the art hearing aids, beam-forming is often used as a means for spatial filtering with the purpose of attenuating noise coming from directions other than a desired listening direction. Beam-forming may e.g. be implemented by generating a beam-formed signal as a weighted combination of a multitude M of electric input signals, e.g. provided by respective microphones. As an example, for M=2, beam-formed signal $Y_{BF}(k, m)$ may be generated from electric input signals $X_1(k, m)$ and $X_2(k, m)$ from first and second microphones ($M_1$, $M_2$) as $Y_{BF}(k, m)=W_1(k, m)\,X_1(k, m)+W_2(k, m)\,X_2(k, m)$, where $W_1(k, m)$ and $W_2(k, m)$ are complex weights, k is a frequency sub-band index and m is a time index.

A side-effect of beam-forming is the fact that the individual microphone gains $G_{DIR,i}$ (e.g. represented by complex weights $W_1(k, m)$, $W_2(k, m)$, so that $G_{DIR,i}=|W_i(k, m)|$) can be large, although the acoustic amplification of the target sound by the beam-former is zero dB (gain=1). This may for example be the case for beam-forming in the low frequency region. Another example is an MVDR (Minimum Variance Distortion-less Response) beam-former, with an angle of interest in the front, which places a null towards a noise point-source close to the front direction.

Each microphone gain (e.g. $G_{DIR,i}$ for the $i^{th}$ microphone, i=1, . . . , M, M≥2) contributes to the (mechanical) loop gain for a particular microphone, which is equal to the forward gain from the microphone to the device output added to the feedback gain (e.g. represented by the transfer function from the output transducer back to the corresponding microphone via the device hardware (in a FOG-measurement situation where no air-borne acoustic feedback from the output transducer to the microphone is present). In a free-field setup (where reflections are ignored), the latter contribution is mainly dependent on the device mechanics. When a loop-gain exceeds 0 dB, the device will be instable and can produce feedback artefacts (also known as mechanical feedback).

A hearing aid normally limits the amplification at the FOG Limit $G_{FOG}$ (maximum allowable gain at which a hearing aid is stable). But limiting the hearing aid amplification will not give the correct result when beam-forming is used prior to amplification, since it also contributes to the loop-gain.

In typical prior art solutions, a gain margin refers to the amount of added gain that can be given to the user, when introducing anti-feedback solution(s), such that the (acoustic) loop gain is the same.

According to the present disclosure, the electrical gain consists of a) a beamformer part (for noise reduction) dynamically determining 'beamformer gain' to provide a specific beam-forming (spatial filtering), and b) an amplification part dynamically providing frequency and level dependent 'amplification gain', e.g. to compensate for a user's hearing impairment (sometimes denoted hearing aid gain' or 'requested gain').

'Full on Gain' (FOG) represents the maximum gain (electrical gain) that can be given by the device in a situation where there is no acoustic coupling between the receiver and the microphones, such that the device is stable (i.e. there is no mechanical feedback).

In the solutions of the present disclosure, it is assumed that the electrical gain should never exceed the FOG-value.

In the solutions of the present disclosure, the following strategy is pursued:

A) the amplification gain is reduced, in order to not exceed the FOG-value, and/or B) beamformer gain(s) is/are reduced, in order to lower the electrical gain (to minimize necessary amplification gain reduction in order not to exceed the FOG-value).

Thus, priority is given to the amplification gain (to compensate for a user's hearing impairment). This means that when the amplification gain is lower than FOG, there will be a budget for using gain for beamforming.

So in other words. We have a gain budget with a maximum defined by the FOG value, then we have first priority amplification gain, second priority is gain for beamforming and then there may be unused gain (depending on the situation).

A Hearing Aid:

In an aspect of the present application, a hearing aid is provided. The hearing aid comprises

- a forward path comprising
  - a multitude of input units for providing a multitude of electric input signals $IN_i$, i=1, . . . , M, representative of sound,
  - a multi input beam former filtering unit for providing a beam formed signal $Y_{BF}$ from said multitude of electric input signals,
  - a gain unit for applying a hearing aid gain $G_{HA}$ to said beam formed signal $Y_{BF}$, and providing a processed signal, and
  - an output unit for providing stimuli perceivable by a user as sound based on said processed signal or a signal derived therefrom.

The hearing aid further comprises a gain control unit for limiting said hearing aid gain $G_{HA}$, to a modified full-on gain value $G'_{FOG}$. The multi input beam former filtering unit is configured to apply a current frequency dependent directional gain $G_{DIR,i}$ to each of said multitude of electric input signals $IN_i$, and the gain control unit is configured to determine the modified full-on gain value $G'_{FOG}$ in dependence of said current directional gains $G_{DIR,i}$ i=1, . . . , M, and a previously determined full-on gain value $G_{FOG}$.

Thereby an improved hearing aid is provided.

The 'hearing aid gain' is in the present context taken to mean the resulting gain from various processing algorithms (e.g. level compression, frequency transposition, etc.) applied to the beam formed signal, including a gain applied to compensate for a frequency and level dependent hearing impairment of the user.

The full-on gain limitation $G_{FOG}$ is a characteristic of the hardware of the hearing aid and represents the maximum gain that can be applied to the hearing aid without causing mechanical feedback. The full-on gain value $G_{FOG}$ is typically determined during manufacturing and stored in a memory of the hearing aid. In an embodiment, the previously determined full-on gain value $G_{FOG}$, is a value determined during manufacturing (or fitting to a particular user) and stored in a memory of the hearing aid. In an embodiment, the previously determined full-on gain value $G_{FOG}$, is a value that has been updated during use of the hearing aid, e.g. in connection with a modification of hearing aid parts or parameters having influence on mechanical feedback, e.g. in case a loudspeaker is exchanged. In an embodiment, the previously determined full-on gain value $G_{FOG}$ is determined and stored in a number of frequency sub-bands, e.g. $G_{FOG}(k)$, k=1, . . . , K, where k is a frequency sub-band index, and K is the number of frequency sub-bands.

A mechanical loop gain for the microphone path is equal to $LG_{mech,i}=G_{DIR,i}+G_{HA}+G_{FBmech,i}$ [dB] for the $i^{th}$ frequency sub-band. The gain control unit is configured to use the full-on gain value $G_{FOG}$ as an upper limitation on the current hearing aid gain $G_{HA}$ in an attempt to maintain loop gain $LG_i$ below 0 dB. In an embodiment, the hearing aid gain $G_{HA}$ is limited to the modified full-on gain $G'_{FOG}$, if a requested gain $G_{HA}$ (e.g. to compensate for a hearing impairment of a user and considering the processing algorithms applied to the beam formed signal at a given point in time) is larger than the modified full-on gain value $G'_{FOG}$ (i.e. $G'_{HA}=\text{MIN}\{G_{HA}, G'_{FOG}\}$).

In an embodiment, the directional gain is dynamically accounted for by setting $G'_{FOG}=G_{FOG}-G_{DIR,max}$ [dB], where $G_{FOG}$ is the previously determined full-on gain, and $G_{DIR,max}$ is equal to MAX $\{G_{DIR,i}\}$, i=1, . . . , M. In an embodiment, the gain control unit is configured to determine a current modified full-on gain value $G'_{FOG}$ in dependence of a maximum value $G_{DIR,max}$ of said current directional gains $G_{DIR,i}$, i=1, . . . , M. In an embodiment, the gain control unit is configured to determine a current modified full-on gain value $G'_{FOG}$ in dependence of a maximum value $G_{DIR,max}$ of said current directional gains $G_{DIR,i}$, i=1, . . . , M, and the previously determined full-on gain value $G_{FOG}$. In an embodiment, the gain control unit is configured to dynamically determine a gain limit correction $\Delta G_{FOG}$ in dependence of a maximum value $G_{DIR,max}$ of the current directional gains $G_{DIR,i}$, i=1, . . . , M. In an embodiment, the gain control unit is configured to limit the hearing aid gain $G_{HA}$ to the modified full-on gain value $G'_{FOG}$ based on a previously determined full-on gain value $G_{FOG}$ dynamically corrected by the gain limit correction $\Delta G_{FOG}$. In an embodiment, the gain limit correction $\Delta G_{FOG}$ is equal to the maximum value $G_{DIR,max}$ of the current directional gains $G_{DIR,i}$, i=1, . . . , M, in other words $\Delta G_{FOG}=\text{MAX}\{G_{DIR,i}\}$, i=1, . . . , M. In an embodiment, $G'_{FOG}=G_{FOG}-\Delta G_{FOG}$ [dB]$=G_{FOG}-G_{DIR,max}$ [dB]. This correction (gain redistribution) scheme ensures that hearing aid gain can be maintained without mechanical instability to a certain extent (in case the target gain is close to the full-on gain limit).

Other (less optimal) measures of the (distribution of the) directional gains than the MAX-function could be used, e.g. an average or a weighted average. In an embodiment, the gain control unit is configured to dynamically determine a gain limit correction $\Delta G_{FOG}$ in dependence of an average value $G_{DIR,avg}$ of the current directional gains $G_{DIR,i}$, i=1, . . . , M, in other words $\Delta G_{FOG}=\text{AVG}\{G_{DIR,i}\}$, i=1, . . . , M, e.g. $\Delta G_{FOG}=(1/M)\cdot\text{SUM}\{G_{DIR,i}\}$, i=1, . . . , M, where AVG is an average operator and SUM is a summation operator.

In an embodiment, the multitude M of input units comprise a number of microphones, such as each comprise a microphone. In an embodiment, M=2. In an embodiment, M=3. In an embodiment, M=4. In an embodiment, M is larger than 4.

In an embodiment, the gain control unit is configured to determine the modified full-on gain value $G'_{FOG}$ as a difference between the previously determined full-on gain value $G_{FOG}$ and the maximum value $G_{DIR,max}$ of the current directional gains, $G'_{FOG}=G_{FOG}-G_{DIR,max}$. In an embodiment, the gain control unit is configured to determine the modified full-on gain value $G'_{FOG}$ as a difference between the previously determined full-on gain value $G_{FOG}$ and the maximum value $G_{DIR,max}$ of the current directional gains, multiplied by a positive (possibly frequency dependent) constant $\alpha$ $G'_{FOG}=G_{FOG}-\alpha G_{DIR,max}$. In an embodiment, $\alpha>0$. In an embodiment, $1\geq\alpha>0$. In an embodiment, $\alpha=1$.

In an embodiment, the gain control unit comprises a configurable smoothing unit configured to determine a smoothed value $\langle G_{DIR,max}\rangle$ of the maximum value $G_{DIR,max}$ of the current directional gains, and to use the smoothed value $\langle G_{DIR,max}\rangle$ in the determination of the modified full-on gain value $G'_{FOG}$, e.g. $G'_{FOG}=G_{FOG}\langle G_{DIR,max}\rangle$. The configurable smoothing unit may e.g. be configured to use different attack ($\tau_{att}$) and release ($\tau_{rel}$) times for the smoothing. In an embodiment, the smoothing attack and/or release time are controllable in dependence of one or more parameters.

In an embodiment, the gain control unit is configured to control a release time and/or an attack time of the configurable smoothing unit in dependence of a current full on gain margin $\Delta G_{FOGm}$, $\Delta G_{FOGm}$ being a difference between the previously determined full-on gain value $G_{FOG}$ and the sum of the current hearing aid gain $G_{HA}$ and the maximum value $G_{DIR,max}$ of the current directional gains $\Delta G_{FOGm}=G_{FOG}-(G_{HA}+G_{DIR,max})$.

In an embodiment, the gain control unit is configured to set a release time constant $\tau_{rel}$ involved in determining the smoothed value $\langle G_{DIR,max}\rangle$ to a value smaller than or equal to a first value $\tau_{rel,FAST}$, in case the current full-on gain margin $\Delta G_{FOGm}$ is below a first threshold value $\Delta G_{LIM,fast}$, i.e. for $\Delta G_{FOGm}<\Delta G_{LIM,fast}$, where $\Delta G_{LIM,fast}$ is larger than zero. This is advantageous to ensure a fast and immediate adaptation of the modified full-on gain value $G'_{FOG}$, in case the current full on gain margin $\Delta G_{FOGm}$ becomes small (i.e. close to zero). In an embodiment, the gain control unit is configured to set the release time constant $\tau_{rel}$ to the first value $\tau_{rel,FAST}$, when the current full on gain margin $\Delta G_{FOGm}$ is below the first threshold value $\Delta G_{LIM,FAST}$. In an embodiment, the gain control unit is configured to increase the release time constant $\tau_{rel}$ when the current full on gain margin $\Delta G_{FOGm}$ is increased above the threshold value $\Delta G_{LIM,FAST}$. In an embodiment, the gain control unit is configured to increase the release time constant $\tau_{rel}$ when the current full on gain margin $\Delta G_{FOGm}$ is increased above the (first) threshold value $\Delta G_{LIM,FAST}$, but below a second threshold value $\Delta G_{LIM,SLOW}$. In an embodiment, the gain control unit is configured to set the release time constant $\tau_{rel}$ to a second value $\tau_{rel,SLOW}$, when the current full on gain margin $\Delta G_{FOGm}$ is increased above the second threshold value $\Delta G_{LIM,SLOW}$ (see e.g. FIG. 3B).

In an embodiment, the gain control unit is configured to adapt the attack time constant $\tau_{att}$ involved in determining the smoothed value $<G_{DIR,max}>$ to the application in question. In an embodiment, the gain control unit is configured to adapt the currently used attack time constant $\tau_{att}$ to a value larger than or equal to the currently used release time constant $\tau_{rel}$. In an embodiment, the gain control unit is configured to set the currently used attack time constant $\tau_{att}$ to a value $\tau_{att,x}$, larger than or equal to the second value $\tau_{rel,SLOW}$ of the release time constant $\tau_{rel}$.

The control of the smoothing by controlling the attack and release times involved in the smoothing of $G_{DIR,MAX}$ is intended to minimize artifacts (and thus to improve sound quality).

In an embodiment, the gain control unit is configured to control the beam former filtering unit in dependence of the maximum value $G_{DIR,max}$ of the current directional gains.

In an embodiment, the gain control unit is configured to control the beam former filtering unit in dependence of the previously determined full-on gain value $G_{FOG}$, the current hearing aid gain $G_{HA}$ and the maximum value $G_{DIR,max}$ of the current directional gains. In an embodiment, the gain control unit is configured to control the beam former filtering unit in dependence of the current full on gain margin $\Delta G_{FOGm}$, $\Delta G_{FOGm}$ being a difference between the previously determined full-on gain value $G_{FOG}$ and the sum of the current hearing aid gain $G_{HA}$ and the maximum value $G_{DIR,max}$ of the current directional gains $\Delta G_{FOGm}=G_{FOG}-(G_{HA}+G_{DIR,max})$.

In an embodiment, the gain control unit is configured to determine a beam former control signal DIRctr for controlling the beam former filtering unit between an un-restrained ON-state, when said current full on gain margin $\Delta G_{FOGm}$ is above a first threshold value $\Delta G_{DIR,ON}$, and an OFF-state, when said current full on gain margin $\Delta G_{FOGm}$ is below a second threshold value $\Delta G_{DIR,OFF}$. In an embodiment, the unrestrained ON-state of the beam former filtering unit is taken to be a state where the beam former filtering unit is un-restrained by the gain control unit, and free to operate normally. In an embodiment, an OFF-state of the beam former filtering unit is taken to be a state where the beam former filtering unit is not dynamically updated, e.g. in that it relies on a fixed beam pattern, e.g. in an omni-directional mode of operation. In an embodiment, the current directional gains $G_{DIR,i}$, i=1, . . . , M, are equal, such as all equal to 0.5 or 1, when the beam former filtering unit is in the OFF-state. In an embodiment, an ON-state is a state between an OFF-state and an un-restrained ON-state where the current directional gains $G_{DIR,i}$, i=1, . . . , M are influenced by the gain control unit via beam former control signal DIRctr. In an embodiment, the beam former control signal DIRctr takes values between 0 and 1 when the beam former filtering unit changes between the OFF-state and the unrestrained ON-state, respectively.

In an embodiment, the control signal DIRctr is frequency dependent, DIRctr=DIRctr(k), k=1, 2, . . . , K.

In an embodiment, the current directional gains $G_{DIR,i}$, i=1, . . . , M as determined by the beam former filtering unit (e.g. according to the current directions and relative levels of to the target and noise signal sources) are modified to $G'_{DIR,i}$, i=1, . . . , M, where $G'_{DIR,i}=DIRctr(k)\cdot G_{DIR,i}(k)$, i=1, . . . , M, k=1, 2, . . . , K, when the beam former filtering unit is controlled by the gain control unit (i.e. when the beam former filtering unit is in the (transition) 'ON-state', where $\Delta G_{DIR,OFF}\leq\Delta G_{FOGm}\leq\Delta G_{DIR,ON}$, cf. e.g. FIG. 3A, left part).

The control of the beam former filtering unit may be independent of the control of the release time constant $\tau_{rel}$ involved in determining the smoothed value $<G_{DIR,max}>$.

In an embodiment, threshold values ($\Delta G_{DIR,OFF}$, $\Delta G_{DIR,ON}$) of the current full on gain margin $\Delta G_{FOGm}$ for activating and deactivating beam forming are smaller than the threshold values ($\Delta G_{LIM,SLOW}$; $\Delta G_{LIM,FAST}$) for controlling the smoothing of the modified full-on gain value G' ($<G_{DIR,max}>$).

In an embodiment, the gain control unit is configured to determine a smoothed value $<\Delta G_{FOGm}>$ of said current full on gain margin $\Delta G_{FOGm}$, and to use said smoothed value $<\Delta G_{FOGm}>$ in the determination of the beam former control signal DIRctr instead of said current full on gain margin $\Delta G_{FOGm}$.

In an embodiment, the hearing aid comprises a multitude M of analysis filter banks each for providing a time-frequency representation $IN_i(k,m)$ of a respective different one of the multitude of electric input signals $IN_i$, i=1, . . . , M, k being a frequency sub-band index and m being a time index. In an embodiment, the various gain values (e.g. $G_{DIR,i}$, $G_{HA}$, $G_{FOG}$, etc.) needed to determine a modified full-on gain $G'_{FOG}$ are provided in a time-frequency representation (k, m), e.g. in a number K of (overlapping or non-overlapping) frequency sub-bands.

In an embodiment, the hearing aid comprises a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

In an embodiment, the hearing aid is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing aid comprises a signal processing unit for enhancing the input signals and providing a processed output signal.

The hearing aid comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing aid comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. The hearing device comprises a directional microphone system adapted to spatially filter sounds from the environment, e.g. to enhance a target acoustic source among a multitude of acoustic sources in the local environment of the user wearing the hearing device. In an embodiment, the directional system is adapted to detect (such as adaptively detect) from which direction a particular part of the microphone signal originates. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing aid comprises an antenna and transceiver circuitry for wirelessly receiving a direct electric input signal from another device, e.g. a communication device or another hearing aid, via a wireless link. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the hearing aid comprises antenna and transceiver circuitry for establishing a wireless link based on near-field communication as well as antenna and transceiver circuitry for establishing a wireless link based on far-field, electromagnetic radiation.

In an embodiment, the wireless link is based on a standardized or proprietary technology. In an embodiment, the far-field wireless link is based on Bluetooth technology (e.g. Bluetooth Low-Energy technology) or similar technology.

In an embodiment, the hearing aid is portable device, e.g. a device comprising a local energy source, e.g. a battery, e.g. a rechargeable battery.

In an embodiment, the forward or signal path between an input unit, e.g. an input transducer (microphone system and/or direct electric input (e.g. a wireless receiver)) and the output unit (e.g. an output transducer) comprises a signal processing unit. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing aids comprise an analogue-to-digital (AD) converter to digitize an analogue input with a predefined sampling rate, e.g. 20 kHz. In an embodiment, the hearing aids comprise a digital-to-analogue (DA) converter to convert a digital signal to an analogue output signal, e.g. for being presented to a user via an output transducer.

In an embodiment, the hearing aid comprises a filter bank. In an embodiment, the filter bank comprises an analysis filter bank comprising a plurality of M first filters $h_k(n)$, where k=0, 1, . . . , K−1 is a frequency band index, and a synthesis filter bank comprising a plurality of K second filters $g_k(n)$, k=0, 1, . . . , K−1. In an embodiment, the analysis filter bank provides a time-frequency representation of an input signal. In an embodiment, the time-frequency representation comprises an array or map of corresponding complex or real values of the signal in question in a particular time and frequency range. In an embodiment, the analysis filter bank is configured to filter a (time varying) input signal and provide a number of (time varying) sub-band signals each comprising a distinct frequency range of the input signal. In an embodiment, the analysis filter bank comprises a Fourier transformation algorithm (e.g. a Fast Fourier transformation algorithm) for converting a time variant input signal to a (time variant) signal in the frequency domain.

In an embodiment, the frequency range considered by the hearing aid from a minimum frequency $f_{min}$ to a maximum frequency $f_{max}$ comprises a part of the typical human audible frequency range from 20 Hz to 20 kHz, e.g. a part of the range from 20 Hz to 12 kHz.

In an embodiment, a signal of the forward and/or analysis path of the hearing aid is split into a number NI of frequency sub-bands, where NI is e.g. larger than 5, such as larger than 10, such as larger than 50, such as larger than 100, such as larger than 500, at least some of which are processed individually. In an embodiment, the hearing aid is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing aid comprises a voice activity detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing aid comprises an own voice detector for detecting whether a given input sound (e.g. a voice) originates from the voice of the user of the system. In an embodiment, the microphone system of the hearing aid is adapted to be able to differentiate between a user's own voice and another person's voice and possibly from NON-voice sounds.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing aid.

In an embodiment, the hearing aid comprises an acoustic (and/or mechanical) feedback suppression system. In an embodiment, the feedback suppression system comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing aid). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part according to a predefined or adaptively controllable scheme (e.g. with a configurable update frequency $f_{upd}$). The update control scheme is preferably supported by one or more detectors of the hearing aid, preferably included in a predefined criterion comprising the detector signals.

In an embodiment, the hearing aid further comprises other relevant functionality for the application in question, e.g. compression, noise reduction, etc.

In an embodiment, the hearing aid comprises a hearing instrument, e.g. a hearing instrument adapted for being located at the ear or fully or partially in the ear canal of a user or fully or partially implanted in the head of a user, or a combination thereof.

Use:

In an aspect, use of a hearing aid as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the output transducer, e.g. a loudspeaker, to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing aid is furthermore provided. The hearing aid comprises a forward path comprising a multitude of input units for providing a multitude of electric input signals $IN_i$, i=1, . . . , M, representative of sound, an output unit for providing stimuli perceivable by a user as sound based on a processed signal or a signal derived therefrom.

The method comprises providing a beam formed signal $Y_{BF}$ from said multitude of electric input signals, applying a current frequency dependent directional gain $G_{DIR,i}$ to each of said multitude of electric input signals $IN_i$, i=1, 2, . . . , M applying a hearing aid gain $G_{HA}$ to said beam formed signal $Y_{BF}$, and providing a processed signal, and providing a previously determined full-on gain value $G_{FOG}$, limiting said hearing aid gain $G_{HA}$ to a modified full-on gain value $G'_{FOG}$, and determining said modified full-on gain value $G'_{FOG}$ in dependence of said current directional gains $G_{DIR,i}$, i=1, . . . , M, and said previously determined full-on gain value $G_{FOG}$.

It is intended that some or all of the structural features of the (hearing aid) device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Computer Program:

A computer program (product) comprising instructions which, when the program is executed by a computer, cause the computer to carry out (steps of) the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid. In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme). In an embodiment, the auxiliary device is or comprises a communication device, e.g. a telephone, e.g. a smartphone, or a device allowing exchange of data with other devices.

In an embodiment, the auxiliary device is another hearing aid. In an embodiment, the hearing system comprises two hearing aids adapted to implement a binaural hearing system, e.g. a binaural hearing aid system.

Definitions:

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing instruments, headsets, ear phones, active ear protection systems.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
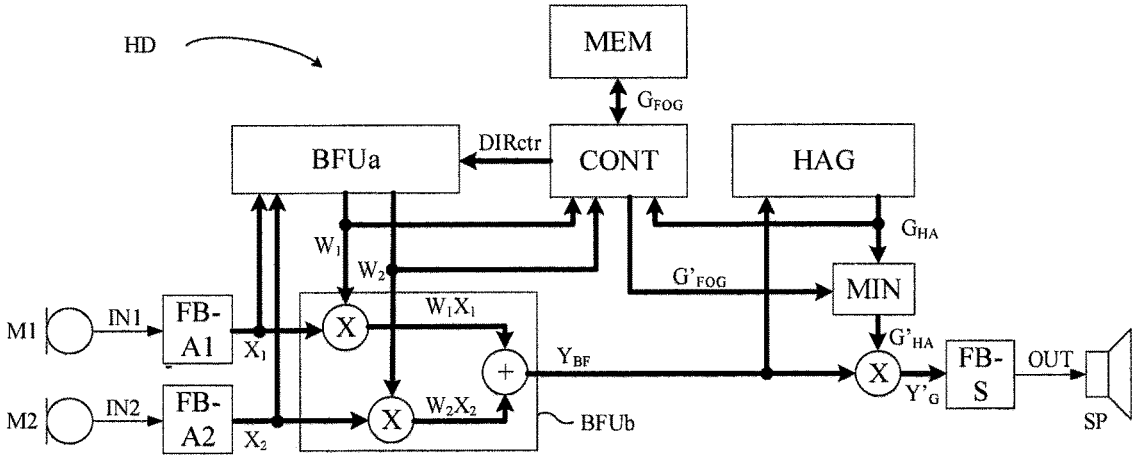
FIG. 1 shows an exemplary first embodiment a hearing aid comprising control unit for implementing a Full-On Gain limitation system connected to a beam former filtering unit and an amplification unit according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to a hearing device comprising a signal processing unit allowing the execution of a number of configurable processing algorithms, e.g. level compression algorithms, feedback estimation algorithms, etc. to modify an audio input signal, e.g. according to the needs of a user of the hearing device. More specifically the disclosure deals with Full-on Gain (FOG) Limitation (and/or a maximum output limitation) for controlling the stability of a digital hearing aid by limiting the maximum allowable gain in the hearing aid.

A solution for a FOG Limitation (the 'FOG limit') is proposed, which limits the hearing aid amplification ($G_{HA}$) to a value ($G'_{FOG}$) that is dynamically corrected by the maximum gain ($G_{DIR,max}$) that is given by the directional system ($G'_{FOG}=G_{FOG}-G_{DIR,max}$). We will refer to the correction as the 'FOG Correction' ($\Delta G_{FOG}=G_{FOG}-G_{FOG}=G_{DIR,max}$).

This is a very tractable and simple solution, but it comes at the drawback that fast gain limit changes can give unpleasant audible artefacts for the user. We therefore, in an exemplary embodiment, propose a system that is slower, such that it acts fast when the limit is reached, but retracts at a slow rate, in order to avoid gain-pumping artefacts.

This leads to another drawback for the user. In situations where the directionality system utilizes large microphone gains, the user experiences a lack of gain when the system is in continuous limitation. This comes from the fact that the gain in the microphone channels do not necessary contribute to the acoustical gain.

This disadvantage can be solved by introducing a sluggishness in the FOG Correction such that, when the device gain is not close to the FOG Limit, the correction is slowly varying. However, when the device gain becomes close to the FOG limit, the correction is quickly adapted in order to obtain the correct FOG limitation.

This allows for a second system to retract the directionality gain, also dependent on the closeness of the device gain to the FOG Limit. This means that when the device gain is getting closer to the FOG Limit, as a first step, the directionality system is forced to be less directional. The consequence for the user is that device gain is utilized for amplification prioritized over directionality. When the device gain keeps increasing, the FOG Correction will be accelerated in order to give the correct limitation when the device gain reaches the FOG Limit.

FIG. 1 shows an exemplary first embodiment a hearing aid (HD) comprising control unit (CONT) for implementing a Full-On Gain limitation system connected to a beam former filtering unit (BFUa, BFUb) and an amplification unit (HAG). The hearing aid comprises a forward path for processing an input signal representing sound and providing an enhanced signal for presentation to a user. The forward path comprises a multitude of input units (here microphones M1, M2) for providing a multitude of electric input signals $IN_i$, i=1, . . . , M, representative of sound (here IN1, IN2, i.e. M=two). The input units preferably comprise appropriate analogue to digital conversion units to provide the electric input signals (IN1, IN2) as digital signals. Each microphone path comprises an analysis filter bank (here FB-A1, FB-A2, respectively) for providing the electric input signals (IN1, IN2) in a time-frequency representation as sub-band signals $X_1$ and $X_2$, respectively. The forward path further comprises a multi input beam former filtering unit (BFUa, BFUb) for providing a beam formed signal $Y_{BF}$ from said multitude of electric input signals IN1, IN2 (here from the sub-band signals $X_1$, $X_2$). The forward path further comprises a gain unit (HAG, MIN, 'X') for applying a (possibly limited) hearing aid gain $G'_{HA}$ to the beam formed signal $Y_{BF}$, and providing a processed signal $Y'_G$. The forward path further comprises synthesis filter bank (FB-S) for converting the frequency sub-band signals of the processed signal $Y'_G$ to an output signal OUT in the time domain. The forward path further comprises an output unit (here a loudspeaker SP) for providing stimuli (acoustic or mechanical stimuli) perceivable by a user as sound based on said processed signal or a signal derived therefrom (here the output signal OUT). The hearing aid further comprises a gain control unit (CONT) for limiting the hearing aid gain $G_{HA}$ to a modified full-on gain value $G'_{FOG}$ (via minimum unit (MIN) which provides the minimum of two input gain values (hearing aid gain $G_{HA}$ and modified fill-on gain $G'_{FOG}$) in the form of gain limited hearing aid gain $G'_{HA}$). The beam former filtering unit is configured to apply a current frequency dependent directional gain $G_{DIR,i}$ to each of the multitude of electric input signals $IN_i$, (here gains $G_1$, $G_2$ applied to electric input signals IN1, IN2 (or rather to sub-band versions $X_1$, $X_2$ thereof)). The gain control unit (CONT) is configured to determine the modified full-on gain value $G'_{FOG}$ in dependence of the current directional gains $G_{DIR,i}$, i=1, . . . , M, (here $G_1=|W_1|$, $G_2=|W_2|$) and a previously determined full-on gain value $G_{FOG}$, which is stored in a memory (MEM) of the hearing aid (e.g. provided during manufacturing of the hearing aid or during fitting of the hearing aid to the needs of a particular user). The gain control unit (CONT) is operatively connected to the gain unit (HAG) and receives the current (requested) hearing aid gain $G_{HA}$. In an embodiment, the current (requested) hearing aid gain $G_{HA}$ is used by the gain control unit to influence the temporal effect of changes in the modified value of the full-on gain $G'_{FOG}$, see FIG. 2, 3.

IMPLEMENTATION EXAMPLE

The following example shows how the FOG Limitation System (represented by the gain control unit CONT in FIG. 2) can be implemented in a multichannel sub-band system with complex valued sub-band signals ($X_1$, $X_2$ in FIG. 1) and complex microphone channel gains ($W_1$, $W_2$) in the Directionality System (BFUb in FIG. 1).

Figure 2:
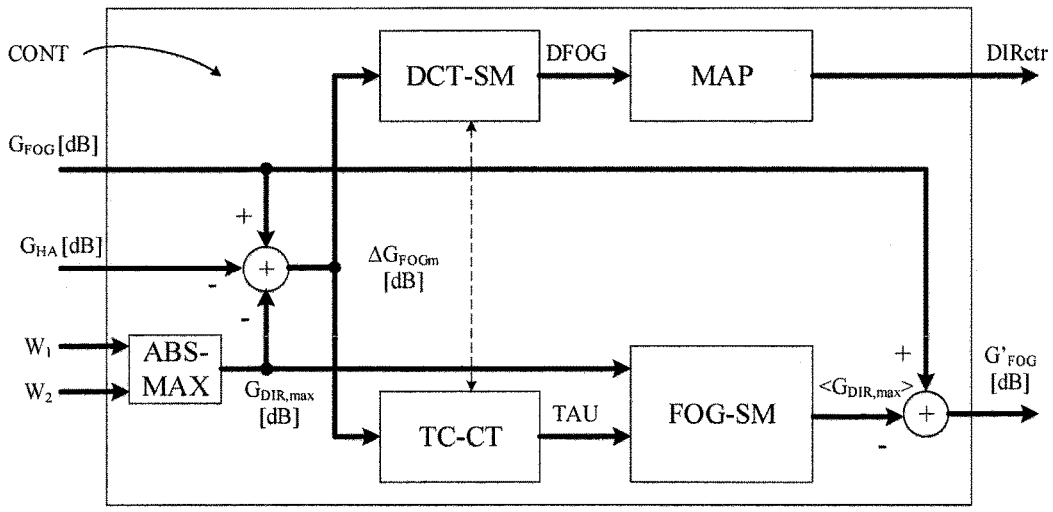
FIG. 2 shows an embodiment of control unit for implementing a Full-On Gain limitation system according to the present disclosure.

FIG. 2 shows an embodiment of control unit (CONT) for implementing a Full-On Gain limitation system according to the present disclosure.

The control unit comprises an ABS-MAX unit providing a maximum value $G_{DIR,max}$ of the current directional gains based on the current complex weights ($W_1$, $W_2$). Since the directionality gains ($W_1$, $W_2$) are complex-valued, they first pass an ABS operation (ABS) providing real gain values G1, G2($G_1=|W_1|$, $G_2=|W_2|$). Subsequently the maximum value is taken over microphone channels 1, 2, $G_{DIR,max}$=MAX $\{G_{DIR,i}\}$, i=1, 2 (MAX) (e.g. for each frequency sub-band k).

After determining the maximum value ($G_{DIR,max}$) among the directional gains ($G_1$, $G_2$), the next step is to calculate the distance (or margin) ($\Delta G_{FOGm}$) between the actual device gain, i.e. Directionality Gain ($G_{DIR,max}$)+Desired Amplification Gain ($G_{HA}$), and the (predetermined) FOG Limit ($G_{FOG}$), cf. inputs to summation unit '+' in FIG. 2 providing $\Delta G_{FOGm}=G_{FOG}-(G_{DIR,max}+G_{HA})$. If the distance measure $\Delta G_{FOGm}$ (also in the following termed the 'current full on gain margin') is positive, the amplification gain $G_{HA}$ does not need limiting. If the value is below zero, the amplification gain needs to be limited in order to maintain the maximum allowable gain for device stability.

The lower part of FIG. 2 comprising time constant control unit TC-CT, smoothing unit FOG-SM, and combination unit '+' is configured to control the FOG Correction $\Delta G_{FOG}=G_{DIR,max}$ dynamically. Only in the case where the FOG Limit $G_{FOG}$ is almost reached ($\Delta G_{FOGm}$, decreases towards 0 (absolute)), the time constant control block (TC-CT) speeds up the calculation of smoothing block FOG-SM (e.g. by decreasing or setting the release time to a low value $\tau_{rel,FAST}$, when the current full on gain margin $\Delta G_{FOGm}$ is smaller than a threshold value $\Delta G_{LIM,fast}$). In other words, the time constant control unit TC-CT controls time constants of the smoothing process and provides time constant control signal TAU to the full-on gain smoothing unit FOG-SM. Based on control signal TAU and the current maximum directional gain value $G_{DIR,max}$ a smoothed maximum directional gain value $<G_{DIR,max}>$ is provided by the full-on gain smoothing unit FOG-SM. A resulting modified full-on gain value $G'_{FOG}$ is provided by combination unit '+' as a difference (in [dB]) between the predefined full-on gain $G_{FOG}$ and the smoothed maximum directional gain value $<G_{DIR,max}>$ (i.e. $G'_{FOG}=G_{FOG}-<G_{DIR,max}>$) Thereby a correct amplification gain limit $G'_{FOG}$ can be (immediately) provided (i.e. $G'_{FOG}\sim G_{FOG}-G_{DIR,max}$), when the hearing aid gain $G_{HA}$ is close to the FOG Limit $G_{FOG}$ (relatively fast or no smoothing) and a slowly varying (slowly smoothed) modified full-on gain value $G'_{FOG}$ can otherwise be provided. The risk of artifacts being introduced by the modification of the full-on gain can thereby be decreased.

The upper part of the drawing comprising DIR-control smoothing unit DCT-SM and mapping unit MAP is configured to determine a control parameter DIRctr (e.g. taking on values between 0 and 1), which can be used to control the directionality system (beamformer filtering unit BFU in FIG. 1. The smoothing unit DCT-SM receives the current full on gain margin $\Delta G_{FOGm}$ from summation unit '+' and provides an appropriate attack and release time to a smoothing of the full on gain margin $\Delta G_{FOGm}$. This is done with a view to the smoothing of the FOG Correction $G_{DIR,max}$ performed in the FOG-SM unit (the current values of attack and release times of the two smoothing processes are e.g. exchange and evaluated, cf. dashed arrow between the respective DCT-SM and TC-CT units). The smoothing unit DCT-SM provides a smoothed full on gain margin $<\Delta G_{FOGm}>$ (signal DFOG in FIG. 2) to the mapping unit MAP. The mapping unit MAP and its control signal DIRctr implements the following scheme for controlling the directionality system (BFUa, BFUb in FIG. 1) based on the smoothed full on gain margin $<\Delta G_{FOGm}>$. A value of the control parameter DIRctr of "0" means that the directionality system is forced to be "off" (no directionality). If the value is "1", the directionality system is free to operate normally (no constraints from the control unit CONT). For values between "0" and "1", the directionality system is restrained to diminish the directional gains as DIRctr decreases from "1" to "0" and thereby to increase the current full on gain margin $\Delta G_{FOGm}$, thus allowing a larger hearing aid gain $G_{HA}$ to be applied to the beam formed signal ($Y_{BF}$ in FIG. 1) before the gain limit ($G'_{FOG}$) is reached. In other words, gain is moved from the directionality system (by decreasing $G_1$, $G_2$) to the hearing aid gain ($G_{HA}$), thereby prioritizing to provide gain $G_{HA}$ to the user at the cost of directionality. The movement of gain from the directionality system to the FOG gain limit (or vice versa) sets restrictions on the time constants for the smoothing of the FOG Correction $G_{DIR,max}$ in the lower part of FIG. 2 and the full on gain margin $\Delta G_{FOGm}$ in the upper part of FIG. 2 (to avoid the introduction of artifacts), as indicated by the dashed connection between the DCT-SM and TC-CT units.

Figure 3A:
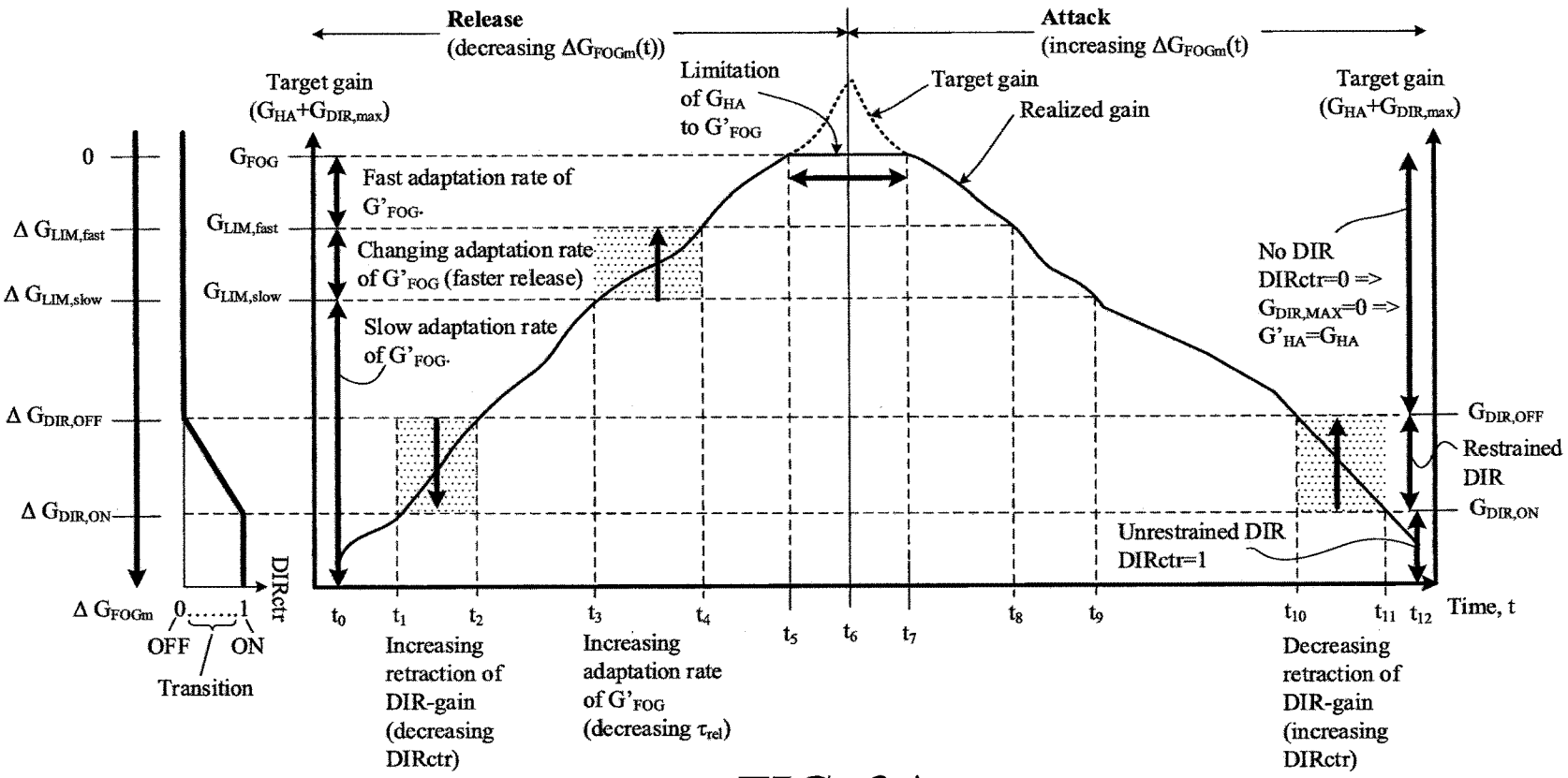
FIG. 3A shows an illustration of an exemplary scheme for operating a gain control unit of a hearing aid according to the present disclosure from start time $t_0$ to an end time $t_{11}$, and in the left part an exemplary functional relationship between the current full on gain margin $\Delta G_{FOG}$, and the beam former control signal DIRctr for controlling the beam former filtering unit.

FIG. 3A is an illustration of an exemplary scheme for operating a gain control unit of a hearing aid according to the present disclosure. FIG. 3A illustrates a situation of increasing need for gain (hearing aid gain $G_{HA}$) to be provided to the user over a first period of time (Time, t), $t_0<t<t_6$, and a second period of time, $t_6<t<t_{12}$, where the need for gain decreases. In an intermediate time period, $t_5<t<t_7$ (overlapping with the first and second time periods), the modified full-on gain sets a limit on the hearing aid gain ($G_{HA}$, providing modified gain $G'_{HA}$). The target gain is indicated in dotted line (during the intermediate time period $t_5<t<t_7$). The realized gain is indicated in solid line (during $t_0<t<t_5$ and $t_7<t<t_{12}$). The left and right vertical axes of the gain graph are gain-axes referring to a 'Target gain' $G_{HA}'$ comprising the sum of the requested hearing aid gain $G_{HA}$ and the FOG correction, $G_{HA}'=G_{HA}+G_{DIR,MAX}$. The leftmost, reversed axis shows the full on gain margin $\Delta G_{FOGm}=G_{FOG}-(G_{DIR,max}+G_{HA})$ having its zero where the requested hearing aid gain $G_{HA}$ is equal to the full-on gain limit $G_{FOG}$ (because $G_{DIR,MAX}=0$ for target gain larger than $G_{DIR,OFF}$, cf. indication on the rightmost target gain axis). Between the leftmost target gain-axis and the full on gain margin $\Delta G_{FOGm}$-axis, a graph illustrating an exemplary functional dependence of the beam former control signal DIRctr on full on gain margin $\Delta G_{FOGm}$ is shown. The shown graph implements a scheme for moving gain from the directionality system to the hearing aid gain (when certain criteria are fulfilled).

In the first time period ($t_0<t<t_6$, denoted 'Release' in the top part of FIG. 3A), a steady increased need for gain is assumed (e.g. corresponding to a situation where a target sound source decreases slowly in signal strength, i.e. received SPL, at the user), or where a noise source is gradually introduced. A steadily increasing target gain corresponds to a steadily decreasing full-on gain margin. Consequently, the release time constant $\tau_{rel}$ of the smoothing algorithm for the full on gain margin $\Delta G_{FOGm}$ is the important one in the first time period (cf. FIG. 3B). The first time period is divided into sub-time periods (determined by individual points in time $t_0$, $t_1$, $t_2$, $t_3$, $t_4$, $t_5$, $t_6$), where the requested hearing aid gain $G_{HA}$ is in different ranges. The reaction of the adaptive full-on gain modification algorithm in each gain-range is briefly discussed in the following.

Time period $t_0<t<t_1$: $G_{HA}'\leq G_{DIR,ON}$ (cf. Target gain scale to the right in FIG. 3A, and the left graph showing DIRctr ($\Delta G_{FOGm}$)): In this gain range, the adaptive full-on gain modification algorithm is slowly reacting and the directional system is unrestrained (by the present algorithm). DIRctr="1".

When the requested hearing aid gain $G_{HA}$ approaches the FOG Limit $G_{FOG}$, from below ($G_{HA}'<G_{FOG}$), the attack/release smoothing and mapping algorithm (c.f. upper part of FIG. 2, units DCT-SM and MAP) controls how fast the directionality system is forced to go from a (normal, unrestrained) mode of operation ($G_{HA}'\leq G_{DIR,ON}$ in FIG. 3A) to the "off" state ($G_{HA}'\geq G_{DIR,OFF}$ in FIG. 3A). It is important to note that these settings have to be set carefully since they are parameters of a recursive system (as mentioned above in connection with FIG. 2). If this system acts too fast, it will result in undesired on/off oscillation of the directionality system.

Time period $t_1<t<t_2$: $G_{DIR,ON}\leq G_{HA}'\leq G_{DIR,OFF}$ (cf. scale to the right in FIG. 3A, and the left graph showing DIRctr ($\Delta G_{FOGm}$)): The directionality system is in a restrained mode of operation (denoted 'Transition' in the left DIRctr ($\Delta G_{FOGm}$)-graph in FIG. 3A) controlled by signal DIRctr, "0"<DIRctr<"1", where directionality gains G1, G2 are decreased with increasing $G_{HA}'$ (cf. downwards pointing bold arrow denoted Increasing retraction of DIR-gain in FIG. 3A). The transition from DIRctr="1" to "0" occurs between times $t_1$ and $t_2$. When the target gain is larger than $G_{DIR,OFF}$ (where the directional system is off), directional gains (G1, G2) are 1 (0 dB), and thus $G_{DIR,MAX}=1$ (0 dB) as indicated on the rightmost target gain axis. This mechanism is important to maintain hearing aid gain (as long as possible, at the cost of DIR-gain).

Time period $t<t_3$: $G_{HA}\leq G_{LIM,slow}$ (cf. axis to the left in FIG. 3A, and FIG. 3B, $\Delta G_{FOGm}\leq\Delta G_{LIM,slow}$): The requested hearing aid gain $G_{HA}'$ is still below the threshold $G_{LIM,slow}$ (i.e. $\Delta G_{FOGm}>\Delta G_{LIM,slow}$ in FIG. 3C), where the modified full-on gain is provided fast, i.e. in a mode (still) providing a Slow adaptation rate of $G'_{FOG}$.

Time period $t_3<t<t_4$: $G_{LIM,slow}\leq G_{HA}'\leq G_{LIM,fast}$ (cf. axis to the left in FIG. 3A, and FIG. 3B, $\Delta G_{LIM,slow}\geq\Delta G_{FOGm}\geq\Delta G_{LIM,fast}$): requested hearing aid gain $G_{HA}'$ is in a range where the modified full-on gain $G'_{FOG}$ is provided with increasing speed for increasing requested hearing aid gain $G_{HA}'$ (but still below a fastest provision, i.e. in a mode providing a Changing adaptation rate of $G'_{FOG}$). Looking at the $\Delta G_{FOGm}$ axis to the left, this corresponds to a decreasing full on gain margin $\Delta G_{FOGm}$ resulting in an increased adaptation rate (i.e. a decreasing release time constant $\tau_{rel}$ (cf. FIG. 3B), so that the modified full-on gain value can be provided (and taken into use) with increased speed the closer we get to the $\Delta G_{LIM,fast}$ threshold.

Time period $t_4<t<t_5$: $G_{LIM,fast}\leq G_{HA}'\leq G_{FOG}$ (cf. axis to the left in FIG. 3A, and FIG. 3B, $\Delta G_{LIM,fast}\geq\Delta G_{FOGm}$): The requested hearing aid gain $G_{HA}'$ is above the threshold for providing immediate (or maximum adaptation rate) of the full on gain margin $\Delta G_{FOGm}$ and thus of the modified full-on gain $G'_{FOG}$ (or rather the full on gain margin $\Delta G_{FOGm}$) ($\Delta G_{FOG}<\Delta G_{LIM,fast}$).

Intermediate time period $t_5<t<t_7$: $G_{FOG}\leq G_{HA}'$ (dotted part of the gain curve). In this time period, the target gain is larger than the full-on gain $G_{FOG}$ and hence the hearing aid gain $G_{HA}$ is limited to the full-on gain value $G'_{FOG}=G_{FOG}$. At time $t_6$, the target gain starts to decrease, which prompts the release time constant $\tau_{rel}$ (cf. FIG. 3B) to change (increase) to a value $\tau_{rel,SLOW}$ providing a slow adaptation rate of the modified full-on gain $G'_{FOG}$. (cf. vertical upwards pointing arrow on the $\tau_{rel}$ axis in FIG. 3B).

In the second time period ($t_6<t<t_{12}$, denoted 'Attack' in the top part of FIG. 3A), a steady decreased need for gain is assumed (e.g. corresponding to a situation where a target sound source increases slowly in signal strength, i.e. received SPL, at the user), or where a noise source is gradually removed or decreased in strength. A steadily decreasing target gain corresponds to a steadily increasing full-on gain margin. Consequently, the attack time constant $\tau_{att}$ of the smoothing algorithm for the full on gain margin $\Delta G_{FOGm}$ is the important one in the second time period (cf. FIG. 3C). The second time period is divided into sub-time periods (determined by individual points in time $t_6$, $t_7$, $t_8$, $t_9$, $t_{10}$, $t_{11}$, $t_{12}$), where the requested hearing aid gain $G_{HA}$ is in different ranges. The reaction of the adaptive full-on gain modification algorithm in each gain-range is briefly discussed in the following.

Time period $t_7<t<t_8$: $G_{LIM,fast}\leq G_{HA}'\leq G_{FOG}$ (cf. axis to the left in FIG. 3A, and FIG. 3C, $\Delta G_{LIM,fast}\geq\Delta G_{FOGm}$): The attack time of the smoothing algorithm for the full on gain margin $\Delta G_{FOGm}$ is set to a fixed relatively large value $\tau_{att,x}$ providing relatively slow adaption of the modified full-on gain $G'_{FOG}$.

Time period $t_8<t<t_9$: $G_{LIM,slow}<G_{HA}'\leq G_{LIM,fast}$ (cf. axis to the left in FIG. 3A, and FIG. 3C, $\Delta G_{LIM,slow}\geq\Delta G_{FOGm}\geq\Delta G_{LIM,fast}$): The attack time of the smoothing algorithm for the full on gain margin $\Delta G_{FOGm}$ stays fixed at the relatively large value $\tau_{att,x}$ providing relatively slow adaption of the modified full-on gain $G'_{FOG}$.

Time period $t_9<t$: $G_{HA}'\leq G_{LIM,slow}$ (cf. axis to the left in FIG. 3A, and FIG. 3C, $\Delta G_{FOGm}\geq\Delta G_{LIM,slow}$): The attack time of the smoothing algorithm for the full on gain margin $\Delta G_{FOGm}$ stays fixed at the relatively large value $\tau_{att,x}$ providing relatively slow adaption of the modified full-on gain $G'_{FOG}$.

Time period $t_{10}<t<t_{11}$: $G_{DIR,ON}\leq G_{HA}'\leq G_{DIR,OFF}$ (cf. scale to the right in FIG. 3A, and the left graph showing DIRctr ($\Delta G_{FOGm}$)): The directionality system is in a restrained mode of operation (denoted 'Transition' in the left DIRctr ($\Delta G_{FOGm}$)-graph in FIG. 3A) controlled by signal DIRctr, "0"<DIRctr <"1", where directionality gains G1, G2 are allowed to increase with decreasing $G_{HA}'$ (cf. upwards pointing bold arrow denoted Decreasing retraction of DIR-gain in FIG. 3A). The transition from DIRctr="1" to "0" occurs between times $t_{10}$ and $t_{11}$. When the target gain is smaller than $G_{DIR,ON}$ (where the directional system is in a normal ON-state), directional gains (G1, G2) are allowed to vary freely (DIRctr=1) in control of the beam former filtering unit.

Time period $t_{11}<t<t_{12}$: $G_{HA}'\leq G_{DIR,ON}$ (cf. Target gain scale to the right in FIG. 3A, and the left graph showing DIRctr($\Delta G_{FOGm}$)): In this gain range, the adaptive full-on gain modification algorithm is slowly reacting and the directional system is unrestrained (by the present full-on gain control algorithm). DIRctr="1".

Figures 3B, 3C:
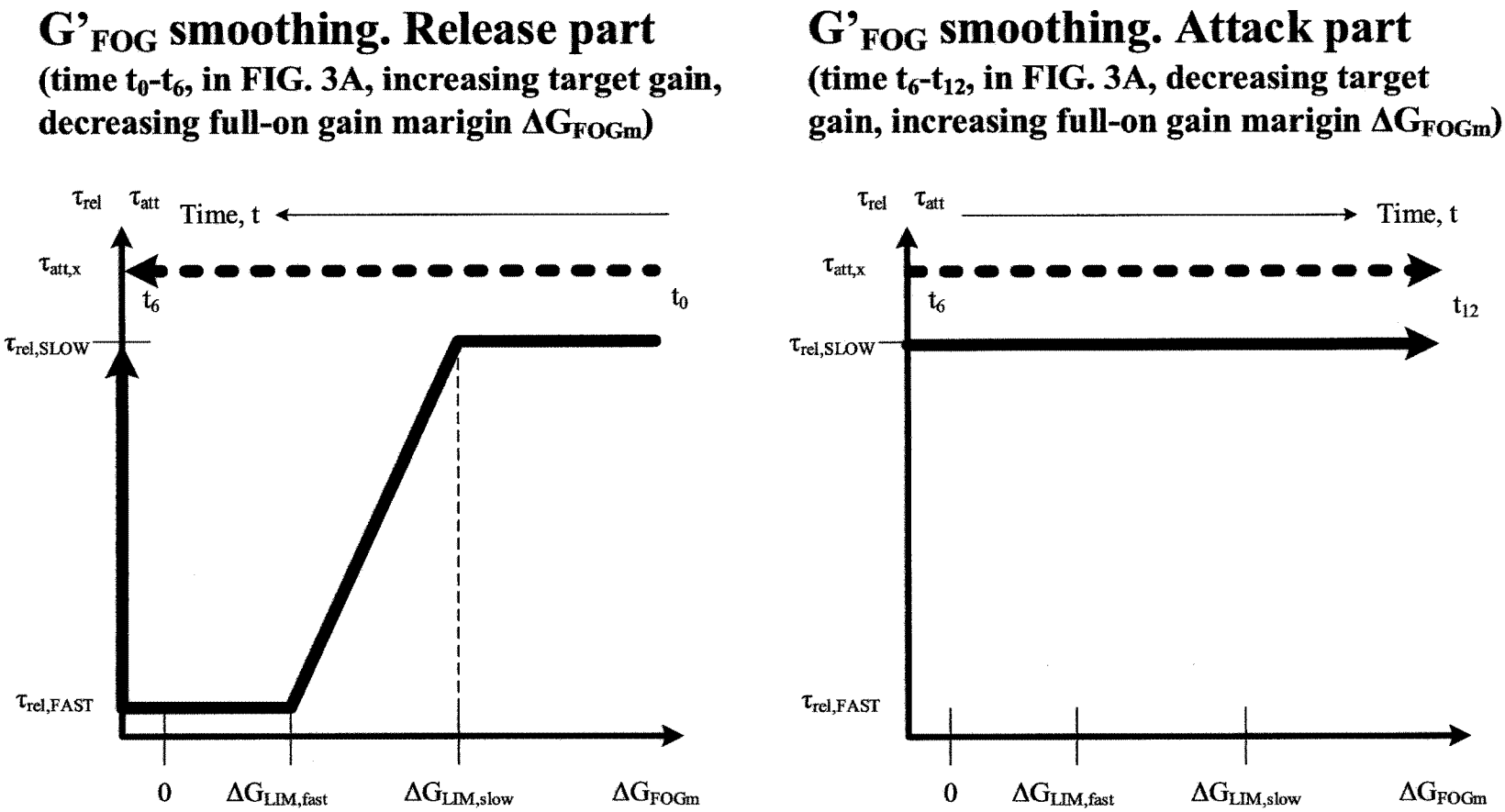
FIG. 3B illustrates an exemplary functional relationship between the current full on gain margin $\Delta G_{FOGm}$ and the attack $\tau_{att}$ and release $\tau_{rel}$ time constants involved in determining the smoothed value $<G_{DIR,max}>$ in a first time interval from a start time $t_0$ to an intermediate time $t_6$ during increasing desired hearing aid gain $G_{HA}$, (i.e. during decreasing full on gain margin $\Delta G_{FOGm}$)
FIG. 3C illustrates an exemplary functional relationship between the current full on gain margin $\Delta G_{FOGm}$ and the attack $\tau_{att}$ and release $\tau_{rel}$ time constants involved in determining the smoothed value $<G_{DIR,max}>$ in a second time interval from an intermediate time $t_6$ to an end time $t_{11}$ during decreasing desired hearing aid gain $G_{HA}$, (i.e. during increasing full on gain margin $\Delta G_{FOGm}$)

FIG. 3B illustrates an exemplary functional relationship between the current full on gain margin $\Delta G_{FOGm}$ and the attack $\tau_{att}$ and release $\tau_{rel}$ time constants involved in determining the smoothed value $<G_{DIR,max}>$ in a first time interval from a start time $t_0$ to an intermediate time $t_6$ during increasing desired hearing aid gain $G_{HA}$, (i.e. during decreasing full on gain margin $\Delta G_{FOGm}$). FIG. 3B corresponds to an increasing target gain situation (first time period $t_0$-$t_6$ denoted Release in FIG. 3A). The time axis (Time, t) indicates start and end of the first time period ($t_0$-$t_6$) in FIG. 3A. The release time constant $\tau_{rel}$ decreases from a larger (slow) time constant $\tau_{rel,SLOW}$ to a smaller (fast) time constant $\tau_{rel,FAST}$, when current full on gain margin $\Delta G_{FOGm}$ decreases from $\Delta G_{LIM,slow}$ to $\Delta G_{LIM,fast}$.In the embodiment of FIG. 3B, the transition from $\tau_{rel,SLOW}$ to $\tau_{rel,FAST}$, is shown to be liner. This need not be the case however. In another embodiment, it may be non-linear, e.g. stepwise linear or of a sigmoid form.

FIG. 3C illustrates an exemplary functional relationship between the current full on gain margin $\Delta G_{FOGm}$ and the attack $\tau_{att}$ and release $\tau_{rel}$ time constants involved in determining the smoothed value $<G_{DIR,max}>$ in a second time interval from an intermediate time $t_6$ to an end time $t_{11}$ during decreasing desired hearing aid gain $G_{HA}$, (i.e. during increasing full on gain margin $\Delta G_{FOGm}$) FIG. 3C corresponds to a decreasing target gain situation (second time period $t_7$-$t_{12}$ denoted Attack in FIG. 3A). The time axis (Time, t) indicates start and end of the second time period ($t_7$-$t_{12}$) in FIG. 3A. The attack and release time constants ($\tau_{att}$, $\tau_{rel}$) are set to constant relatively large values ($\tau_{att}$X $\tau_{rel,SLOW}$), providing relatively slow smoothing (adaptation). In the embodiment of FIG. 3B, 3C, the attack time constant $\tau_{att,x}$ is larger than the release time constant $\tau_{rel,SLOW}$.

Outside the transition of the release time constant from slow to fast $\tau_{rel,SLOW}$ to $\tau_{rel,FAST}$ (FIG. 3B), the attack and release time constants of FIGS. 3B and 3C are shown to be constant ($\tau_{att,x}$, $\tau_{rel,SLOW}$, $\tau_{rel,FAST}$) for varying full on gain margin $\Delta G_{FOGm}$. This need not be the case, however. In an embodiment, one or more of the attack and release time constants are non-linear, e.g. non-linearly, e.g. logarithmically approaching a fixed value.

In an embodiment (with reference to FIG. 3A) $G_{DIR,OFF}=G_{LIM,slow}$, ($\Delta G_{DIR,OFF}=\Delta G_{LIM,slow}$), so that the increase of adaptation rate of the modified full-on gain $G'_{FOG}$ is started when the full directional gain has been moved to the hearing aid gain ($G_{DIR,max}=0$).

In a multi-channel implementation of the directionality system (BFUa, BFUb in FIG. 1) and the amplification system (HAG in FIG. 1), the FOG Limit algorithm according to the present disclosure can be implemented in independent channels. The FOG Limit ($G_{FOG}$, $G'_{FOG}$) is typically a frequency dependent function. The embodiments described in the present disclosure are implemented in the time frequency domain (signals of individual frequency sub-bands are treated individually). The present scheme may, however, be implemented fully or partially in the time domain.

In an embodiment, the gain control unit is configured to determine a beam former control signal DIRctr for controlling the beam former filtering unit between an un-restrained ON-state, when said current full on gain margin $\Delta G_{FOGm}$ is above a first threshold value $\Delta G_{DIR,ON}$, and an OFF-state, when said current full on gain margin $\Delta G_{FOGm}$ is below a second threshold value $\Delta G_{DIR,OFF}$. FIG. 3A (left side) illustrates an exemplary functional relationship between the current full on gain margin $\Delta G_{FOGm}$ and the beam former control signal DIRctr for controlling the beam former filtering unit. The DIRctr($\Delta G_{FOGm}$)-graph in FIG. 3A shows that the beam former filtering control signal DIRctr is set to "1" (corresponding to an un-restrained ON-state of the beamformer filtering unit, e.g. to operate normally), when the current full on gain margin $\Delta G_{FOGm}$ is above a first threshold value $\Delta G_{DIR,ON}$. FIG. 3B further shows that the beam former filtering control signal DIRctr is set to "0" (corresponding to an OFF-state of the beamformer filtering unit), when the current full on gain margin $\Delta G_{FOGm}$ is below a second threshold value $\Delta G_{DIR,OFF}$. In the OFF-state of the beam former filtering unit may e.g. be fixed to an omni-directional mode of operation. FIG. 3A further shows that when the full on gain margin $\Delta G_{FOGm}$ is changed between the first and second threshold values $\Delta G_{DIR,OFF}$, $\Delta G_{DIR,ON}$, the DIRctr signal changes linearly between 0 and 1. In this range, the beamformer filtering unit is in a transition-state between an OFF-state and an un-restrained ON-state, where the current directional gains $G_{DIR,i}$, i=1, . . . , M are influenced (limited, attenuated) by the gain control unit via beam former control signal DIRctr.

In an embodiment, the gain control unit comprises a configurable smoothing unit configured to determine a smoothed value $<G_{DIR,max}>$ of the maximum value $G_{DIR,max}$ of the current directional gains, and to use the smoothed value $<G_{DIR,max}>$ in the determination of the modified full-on gain value $G'_{FOG}$, e.g. $G'_{FOG}=G_{FOG}-<G_{DIR,max}>$. The configurable smoothing unit may e.g. be configured to use different attack and release times for the smoothing. In an embodiment, the smoothing attack and/or release time are controllable in dependence of one or more parameters. FIG. 3B illustrates an exemplary functional relationship between the current full on gain margin $\Delta G_{FOGm}$, and the release time constant $\tau_{rel}$ involved in determining the smoothed value $<G_{DIR,max}>$.

In the exemplary scheme illustrated by FIG. 3B, the gain control unit is configured to set a release time constant $\tau_{rel}$ involved in determining the smoothed value $<G_{DIR,max}>$ to a value equal to a first value $\tau_{rel,FAST}$, in case the current full-on gain margin $\Delta G_{FOGm}$ is below a first threshold value $\Delta G_{LIM,fast}$, i.e. for $\Delta G_{FOGm}<\Delta G_{LIM,fast}$, where $\Delta G_{LIM,fast}$ is larger than zero. This is advantageous to ensure a fast and immediate adaptation of the modified full-on gain value $G'_{FOG}$, in case the current full on gain margin $\Delta G_{FOGm}$ becomes small (i.e. close to zero). According to the scheme of FIG. 3B, the release time constant $\tau_{rel}$ is increased (linearly) when the current full on gain margin $\Delta G_{FOGm}$ is increased above the threshold value $\Delta G_{LIM,fast}$, but below a second threshold value $\Delta G_{LIM,slow}$, In FIG. 3C the release time constant $\tau_{rel}$ is set to a second value $\tau_{rel,SLOW}$, when the current full on gain margin $\Delta G_{FOGm}$ is increased above the second threshold value $\Delta G_{LIM,slow}$.

Typically, the currently used attack time constant $\tau_{att}$ is set to a value larger than or equal to the currently used release time constant $\tau_{rel}$.

Figure 4:
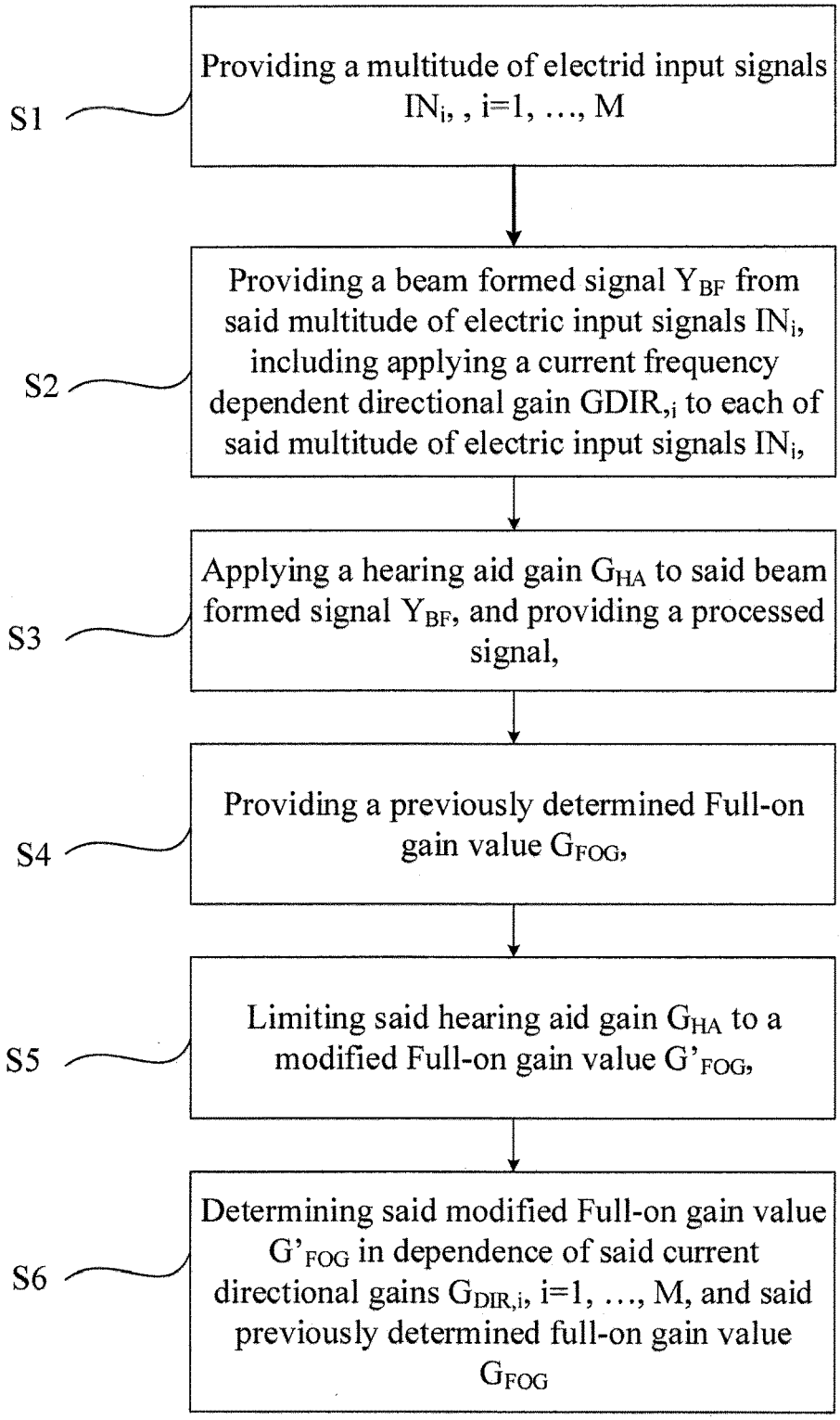
FIG. 4 shows a flow diagram of an embodiment of a method of operating a hearing aid according to the present disclosure.

FIG. 4 shows a flow diagram of an embodiment of a method of operating a hearing aid according to the present disclosure. The hearing aid comprises a forward path comprising a multitude of input units for providing a multitude of electric input signals $IN_i$, i=1, . . . , M, representative of sound, and an output unit for providing stimuli perceivable by a user as sound based on a processed signal or a signal derived therefrom. The method comprises

S1. providing a multitude of electric input signals $IN_i$, i=1, . . . , M, representative of sound,

S2. providing a beam formed signal $Y_{BF}$ from said multitude of electric input signals $IN_i$, including applying a current frequency dependent directional gain $G_{DIR,i}$ to each of said multitude of electric input signals $IN_i$,

S3. applying a hearing aid gain $G_{HA}$ to said beam formed signal $Y_{BF}$, and providing a processed signal, and

S4. providing a previously determined full-on gain value $G_{FOG}$,

S5. limiting said hearing aid gain $G_{HA}$ to a modified full-on gain value $G'_{FOG}$,

S6. determining said modified full-on gain value $G'_{FOG}$ in dependence of said current directional gains $G_{DIR,i}$, i=1, . . . , M, and said previously determined full-on gain value $G_{FOG}$.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid comprising a forward path comprising a multitude of input units for providing a multitude of electric input signals $IN_i$, i=1, . . . , M, representative of sound, a multi input beam former filtering unit for providing a beam formed signal $Y_{BF}$ from said multitude of electric input signals, a gain unit for applying a hearing aid gain $G_{HA}$ to said beam formed signal $Y_{BF}$, and providing a processed signal, and an output unit for providing stimuli perceivable by a user as sound based on said processed signal or a signal derived therefrom, the hearing aid further comprising a gain control unit for limiting said hearing aid gain $G_{HA}$ to a modified full-on gain value $G'_{FOG}$, wherein the multi input beam former filtering unit is configured to apply a current frequency dependent directional gain $G_{DIR,i}$, to each of said multitude of electric input signals $IN_i$, and wherein the gain control unit is configured to determine the modified full-on gain value $G'_{FOG}$ in dependence of said current directional gains $G_{DIR,i}$, i=1, . . . , M, and a previously determined full-on gain value $G_{FOG}$, the gain control unit comprises a configurable smoothing unit configured to determine a smoothed value $<G_{DIR,max}>$ of the maximum value $G_{DIR,max}$ of the current directional gains, and to use the smoothed value $<G_{DIR,max}>$ in the determination of the modified full-on gain value $G'_{FOG}$, e.g. $G'_{FOG}=G_{FOG}-<G_{DIR,max}>$, and the gain control unit is configured to control a release time and/or an attack time of the smoothing unit in dependence of a current full on gain margin $\Delta G_{FOGm}$, $\Delta G_{FOGm}$ being a difference between the previously determined full-on gain value $G_{FOG}$ and the sum of the current hearing aid gain $G_{HA}$ and the maximum value $G_{DIR,max}$ of the current directional gains $\Delta G_{FOGm} = G_{FOG}-(G_{HA}+G_{DIR,max})$.

2. A hearing aid according to claim 1 wherein the gain control unit is configured to determine a current modified full-on gain value $G'_{FOG}$ in dependence of a maximum value $G_{DIR,max}$ of said current directional gains $G_{DIR,i}$, i=1, . . . , M.

3. A hearing aid according to claim 1 wherein the gain control unit is configured to determine a current modified full-on gain value $G'_{FOG}$ in dependence of a maximum value $G_{DIR,max}$ of said current directional gains $G_{DIR,i}$, i=1, . . . , M, and the previously determined full-on gain value $G_{FOG}$.

4. A hearing aid according to claim 1 wherein the gain control unit is configured to determine the modified full-on gain value $G'_{FOG}$ as a difference between the previously determined full-on gain value $G_{FOG}$ and the maximum value $G_{DIR,max}$ of the current directional gains multiplied by a positive constant α, $G'_{FOG}=G_{FOG}-\alpha G_{DIR,max}$.

5. A hearing aid according to claim 1 wherein the gain control unit is configured to set a release time constant involved in determining the smoothed value $<G_{DIR,max}>$ to a value smaller than or equal to a first value $\pi_{rel,FAST}$, in case the current full-on gain margin $\Delta G_{FOGm}$ is below a first threshold value $\Delta G_{LIM,fast}$, i.e. for $\Delta G_{FOGm}<\Delta G_{th,LIM}$, where $\Delta G_{LIM,fast}$ is larger than zero.

6. A hearing aid according to claim 1 wherein the gain control unit is configured to control the beam former filtering unit in dependence of the maximum value $G_{DIR,max}$ of the current directional gains.

7. A hearing aid according to claim 1 wherein the gain control unit is configured to control the beam former filtering unit in dependence of the previously determined full-on gain value $G_{FOG}$, the current hearing aid gain $G_{HA}$ and the maximum value $G_{DIR,max}$ of the current directional gains.

8. A hearing aid comprising a forward path comprising a multitude of input units for providing a multitude of electric input signals $IN_i$, i=1, . . . , M, representative of sound, a multi input beam former filtering unit for providing a beam formed signal $Y_{BF}$ from said multitude of electric input signals, a gain unit for applying a hearing aid gain $G_{HA}$ to said beam formed signal $Y_{BF}$, and providing a processed signal, and an output unit for providing stimuli perceivable by a user as sound based on said processed signal or a signal derived therefrom, the hearing aid further comprising a gain control unit for limiting said hearing aid gain $G_{HA}$, to a modified full-on gain value $G'_{FOG}$, wherein the multi input beam former filtering unit is configured to apply a current frequency dependent directional gain $G_{DIR,i}$ to each of said multitude of electric input signals $IN_i$, and wherein the gain control unit is configured to determine the modified full-on gain value $_{G'FOG}$ in dependence of said current directional gains $G_{DIR,i}$, i=1, . . . , M, and a previously determined full-on gain value $G_{FOG}$, and the gain control unit is configured to control the beam former filtering unit in dependence of the current full on gain margin $\Delta G_{FOGm}$, $\Delta G_{FOGm}$ being a difference between the previously determined full-on gain value $G_{FOG}$ and the sum of the current hearing aid gain $G_{HA}$ and the maximum value $G_{DIR,max}$ of the current directional gains.

9. A hearing aid according to claim 8 wherein the gain control unit is configured to control the beam former filtering unit to reduce said maximum value $G_{DIR,max}$ of the current directional gains, in case the current full on gain margin $\Delta G_{FOGm}$, is smaller than a threshold value.

10. A hearing aid according to claim 8 wherein the gain control unit is configured to determine a beam former control signal DIRctr for controlling the beam former filtering unit between an un-restrained ON-state, when said current full on gain margin $\Delta G_{FOGm}$ is above a first threshold value $\Delta G_{DIR,ON}$, and an OFF-state, when said current full on gain margin $\Delta G_{FOGm}$ is below a second threshold value $\Delta G_{DIR,OFF}$.

11. A hearing aid according to claim 10 wherein the gain control unit is configured to determine a smoothed value $<\Delta G_{FOGm}>$ of said current full on gain margin $\Delta G_{FOGm}$, and to use said smoothed value $<\Delta G_{FOGm}>$ in the determination of the beam former control signal DIRctr instead of said current full on gain margin $\Delta G_{FOGm}$.

12. A hearing aid according to claim 1 comprising a multitude M of analysis filter banks each for providing a time-frequency representation $IN_i(k,m)$ of a respective different one of the multitude of electric input signals $IN_{i,\ i=}1, \ldots, M$, k being a frequency index and m being a time index.

13. A hearing aid according to claim 1 comprising a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

14. A hearing aid according to claim 1 wherein the beamformer filtering unit comprises minimum variance distortionless response (MVDR) beamformer.

15. A hearing aid according to claim 1 wherein the beamformer filtering unit comprises generalized sidelobe canceller (GSC) structure.

16. A method of operating a hearing aid comprising a forward path comprising a multitude of input units for providing a multitude of electric input signals $IN_i$, i=1, . . . , M, representative of sound, an output unit for providing stimuli perceivable by a user as sound based on a processed signal or a signal derived therefrom, the method comprising providing a beam formed signal $Y_{BF}$ from said multitude of electric input signals, applying a current frequency dependent directional gain $G_{DIR,i}$ to each of said multitude of electric input signals $IN_i$, applying a hearing aid gain $G_{HA}$ to said beam formed signal $Y_{BF}$, and providing a processed signal, and providing a previously determined full-on gain value $G_{FOG}$, limiting said hearing aid gain $G_{HA}$ to a modified full-on gain value $G'_{FOG}$, determining said modified full-on gain value $G'_{FOG}$ in dependence of said current directional gains $G_{DIR,i}$, i=1, . . . , M, and said previously determined full-on gain value $G_{FOG}$, determining a smoothed value $<G_{DIR,max}>$ of the maximum value $G_{DIR,max}$ of the current directional gains, and using the smoothed value $<G_{DIR,max}>$ in the determination of the modified full-on gain value $G'_{FOG}$, e.g. $G'_{FOG}=G_{FOG}-<G_{DIR,max}>$, and controlling a release time and/or an attack time of the smoothing in dependence of a current full on gain margin $\Delta G_{FOGm}$, $\Delta G_{FOGm}$ being a difference between the previously determined full-on gain value $G_{FOG}$ and the sum of the current hearing aid gain $G_{HA}$ and the maximum value $G_{DIR,max}$ of the current directional gains $\Delta G_{FOGm}=G_{FOG}-(G_{HA}+G_{DIR,max})$.

17. A data processing system comprising a processor and program code means for causing the processor to perform the steps of the method of claim 16.

18. A non-transitory computer readable medium having stored there on a computer program comprising instructions which, when the program is executed by a computer, cause the computer to carry out the method of claim 16.

* * * * *